US006151849A

United States Patent [19]

Twigg et al.

[11] Patent Number: 6,151,849

[45] Date of Patent: Nov. 28, 2000

[54] COMPOSITE DOOR WITH LITE AND METHOD OF MAKING SAME

[75] Inventors: Patricia Twigg, Gahanna, Ohio; John J. Jurcak, Jr., Liberty, Mo.; John Martini, Missisauga, Canada

[73] Assignee: The Stanley Works, New Britain, Conn.

[21] Appl. No.: 09/208,369

[22] Filed: Dec. 10, 1998

[51] Int. Cl.[7] ..... E06B 5/00; E06B 3/54; E06B 1/00

[52] U.S. Cl. ..... 52/208; 52/204.53; 52/204.62; 52/204.72; 52/784.1; 52/784.15; 52/742.13; 52/745.15; 52/745.19; 52/309

[58] Field of Search ..... 52/208, 204.53, 52/204.54, 204.62, 204.591, 204.71, 204.72, 309.9, 717.01, 455, 784.14, 784.15, 742.13, 745.15, 745.19, 784.1

[56] References Cited

U.S. PATENT DOCUMENTS

| | | | |
|---|---|---|---|
| 2,996,767 | 8/1961 | Kobil et al. | 52/204.591 X |
| 3,750,358 | 8/1973 | Llewkowitz | 52/455 X |
| 3,760,543 | 9/1973 | McAllister | 52/455 X |
| 3,903,669 | 9/1975 | Pease | 52/455 |
| 3,969,857 | 7/1976 | Stark | 52/208 |
| 4,259,818 | 4/1981 | Stark | 52/208 |
| 4,387,542 | 6/1983 | Wehr | 52/209 |
| 4,550,542 | 11/1985 | La See | 52/476 |
| 4,570,399 | 2/1986 | Wentink | 52/208 |
| 4,897,975 | 2/1990 | Artwick et al. | 52/208 |
| 4,947,597 | 8/1990 | Simpson | 52/208 |
| 4,947,606 | 8/1990 | La See | 52/455 |
| 5,018,330 | 5/1991 | Lewkowitz | 52/455 |
| 5,175,970 | 1/1993 | Green | 52/309.9 |
| 5,323,579 | 6/1994 | Ruff | 52/455 |
| 5,369,923 | 12/1994 | Schilt | 52/208 |
| 5,577,355 | 11/1996 | Leonelli | 52/204.62 |
| 5,644,874 | 7/1997 | McKann | 52/202 |
| 5,692,349 | 12/1997 | Guillemet | 52/204.53 |
| 5,749,184 | 5/1998 | McKann | 52/204.1 |
| 5,941,032 | 8/1999 | Lydon | 52/204.1 |

*Primary Examiner*—Robert Canfield
*Attorney, Agent, or Firm*—Pepe & Hazard, LLP

[57] ABSTRACT

A composite door with a lite utilizes panels with aligned cutouts and a foam retainer member which extends about the cutouts between the panels to effect a seal. The retainer has a mounting portion extending inwardly from the cutout periphery. The lite is disposed in the cutout and it is secured by an external frame which has portions overlying the outer surface of the panel and its marginal portion. A clamp secured to the foam retainer and external frame and clamps the lite to the external frame, and an internal frame has portions overlying the outer surface of the other panel and the marginal portion of the other surface of the lite and conceals the clamp and fastener.

15 Claims, 2 Drawing Sheets

COMPOSITE DOOR WITH LITE AND METHOD OF MAKING SAME

BACKGROUND OF THE INVENTION

The present invention pertains to doors with lites and, more particularly, to such doors having a foam core between the skins.

Doors with metal and plastic skins and foam cores enjoy substantial popularity as entry doors due to their strength, and to their temperature and sound insulating qualities. The metal door also exhibit good fire resistance. Many such doors have a transparent panel or lite to provide interior illumination or to permit viewing of the exterior.

The common method of producing composite metal doors with lites is to first produce the composite door with continuous panels and then to cut an opening for the lite, which is then inserted and fastened. This method suffers from several serious disadvantages. Cutting the opening after the plastic foam has been inserted to provide the core produces composite scrap of steel sheet with foam adhering thereto. This cannot be recycled and is costly. Further, cutting the opening after the foam insertion is a messy process requiring labor intensive cleaning of the skins and handling of waste. Further, both the cut door panels and the scrap often have sharp edges that may be hazardous. Finally, it is difficult to position and size the cutout precisely if it is made after the composite door has been assembled and the foam core has been formed. If the openings in the two skins are improperly aligned or oversized, water may leak into the installed door and it may be absorbed by the foam core and it may ultimately result in rusting of the steel skins.

It is an object of the present invention to provide both a novel composite door with a lite which is readily and economically fabricated with less scrap handling problems. It is also an object to provide such a composite door in which the lite is secured by a frame which is easily installed. Another object is to provide a novel method for making such a composite door which eliminates the messy and potentially hazardous process of cutting the composite door after assembly and foam insertion and which reduces the overall labor content of the door.

SUMMARY OF THE INVENTION

It has been found that the foregoing and related objects may be readily attained in a composite door with a lite which has a pair of spaced panels providing the faces of the door and having aligned cutouts. A foam retaining member extends about the periphery of the cutouts with a first portion extending between the panels to effect a seal therewith and a mounting portion extending inwardly of the periphery of the cutouts.

A translucent lite is disposed in the cutouts and is configured cooperatively therewith. An external frame element extends about the periphery of the cutout in one of the panels and it has a first portion overlying the outer surface of the one panel about the cutout and a second portion overlying said mounting portion and a marginal portion of the adjacent surface of the lite. Engaging means secures the mounting portion of the foam retaining member and external frame element in assembly and clamps the lite to the external frame element. An internal frame element extends about the periphery of the cutout in the other of the panels and it has a first portion overlying the outer surface of the other panel about the cutout and a second portion overlying the mounting portion of the retaining member and a marginal portion of the other surface of the lite and the engaging means.

Cellular synthetic resin is disposed in the cavity defined by the panels and the foam retaining member, and the resin abuts the form retaining member.

Generally, the foam retaining member is of generally T-shaped configuration with a head portion extending between the panels to effect the seal and a base portion providing the mounting portion. Conveniently, the panels have inwardly extending lips about the cutouts and the foam retaining member abuts the interior surface of lips.

Desirably, the engaging means includes a clamping plate bearing upon the surface of the lite opposite from that adjacent the external frame element, and fasteners extend through the clamping plate and the mounting portion of the foam retaining member to engage the external frame element. As a result, tightening of the threaded fasteners draws the external frame element towards the plate. Preferably, the clamping plate has a generally L-shaped portion overlying the marginal portion of the lite and a portion of its peripheral edge and a flange which extends over the mounting portion of the foam retaining member. The fasteners extend through the flange and mounting portion.

Desirably, the second portion of the interior frame element has a projection which is frictionally engaged between the foam retaining member and the L-shaped portion of the clamping plate. This projection is dimensioned and configured to snap fit into the spacing between the frame retaining member and L-shaped portion of the clamping plate.

Preferably, the foam retaining member is fabricated of synthetic resin, and sealing means is provided between the lite and the outer frame element.

In the method for forming the composite door, a pair of substantially planar rectangular door panels is assembled in spaced relationship with the cutouts in substantial alignment. The foam retaining member is placed in the cutouts with its first portion extending between the panels and in sealing relationship with the panels about the cutouts and its second portion extending inwardly of the periphery of the cutouts. Synthetic resin foam is introduced into the cavity defined by the panels and against the foam retaining member. Thereafter, a translucent lite is inserted in the cutouts and the lite is secured to the foam second portion of the retaining member by assembling the pair of frame elements therewith.

The frame elements are secured with the lite by providing the external frame element on the external surfaces of one panel and the lite, and a clamping element is placed against the other surface of the lite. The external frame element and clamping element are secured to the second portion of the foam retaining element to clamp the lite between the clamping and frame elements.

BRIEF DESCRIPTION OF THE DRAWINGS

The present invention will be more clearly understood from the following description together with the accompanying drawings in which.

DETAILED DESCRIPTION OF THE PREFERRED EMBODIMENT

Figure 1:
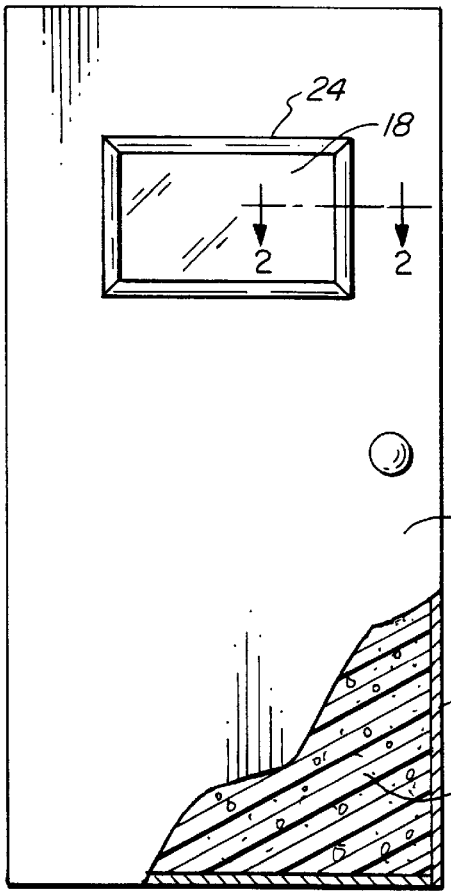
FIG. 1 is a front elevational view, partly broken away, of a composite door containing a lite in accordance with the present invention.

Turning now to the drawings, there is seen in FIG. 1 a metal composite door having a rectangular metal frame 2 and a pair of rectangular steel panels or skins 4 attached thereto. A core 6 of synthetic resin foam is disposed between the panels 4. Aligned cutouts 8 are formed in the panels 4 and the panels 4 have inwardly extending lips 10 bounding the cutouts 8 as seen in FIG. 2.

Figure 2:
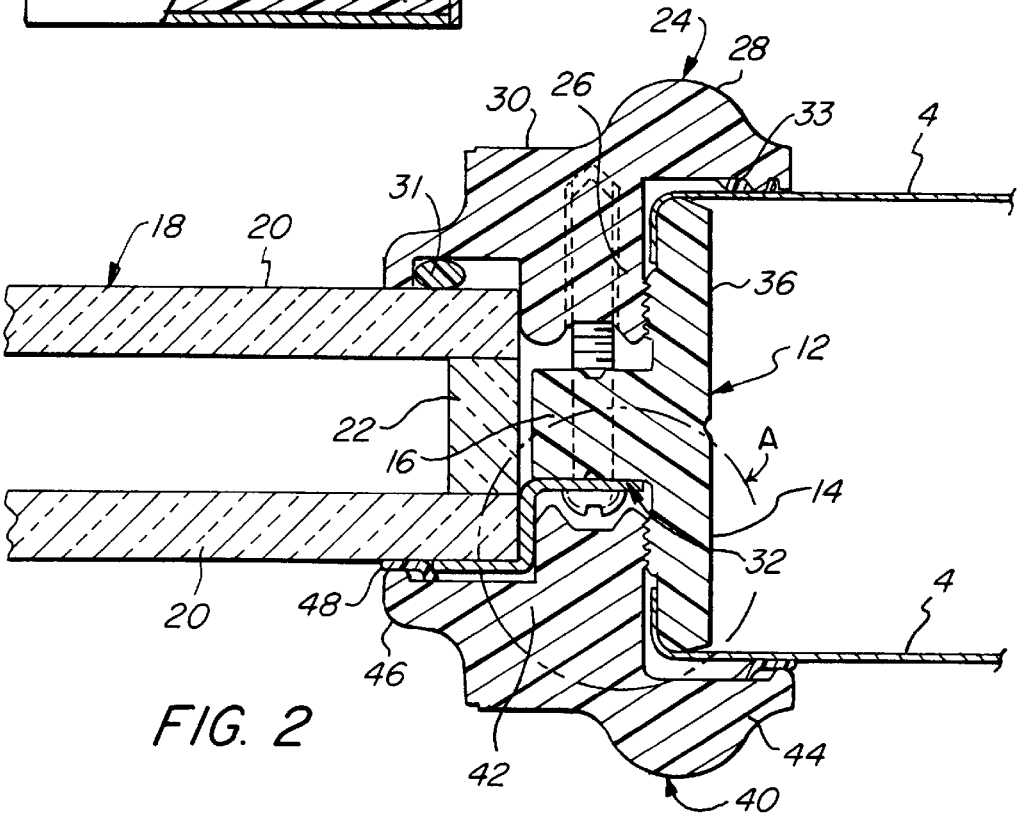
FIG. 2 is an enlarged fragmentary cross-sectional view taken along line 2—2 of FIG. 1.
Figure 3:
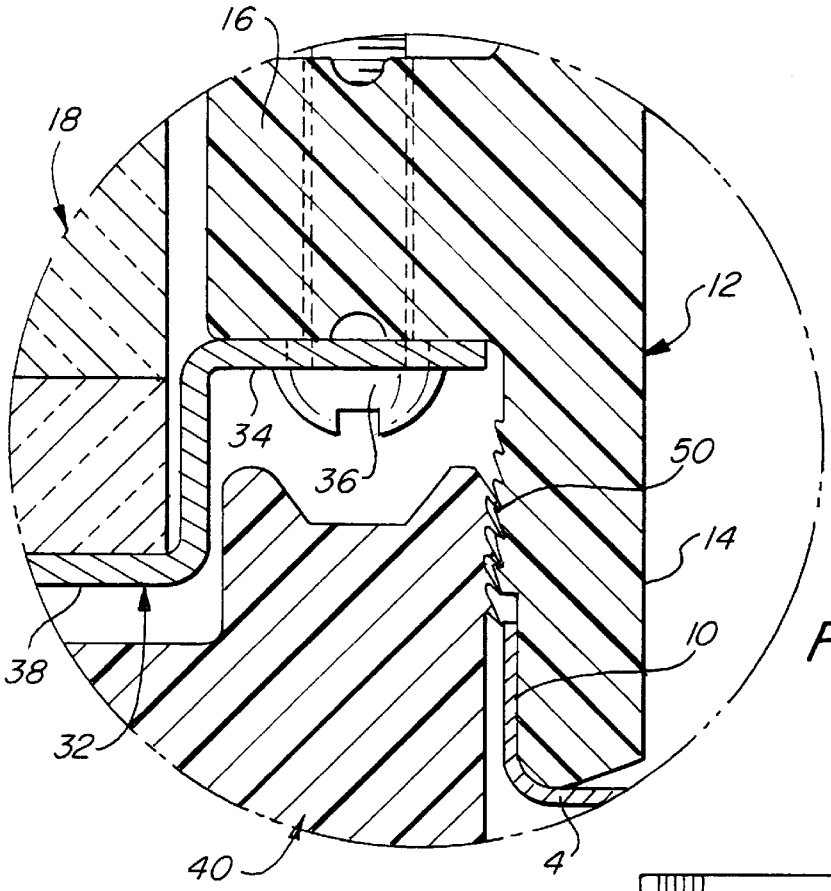
FIG. 3 is an enlarged detail of the area indicated by the letter A in FIG. 2.
Figure 4:
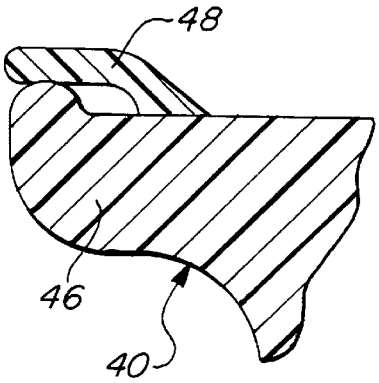
FIG. 4 is an enlarged detail of the area indicated by the Letter B in FIG. 2.
Figure 5:
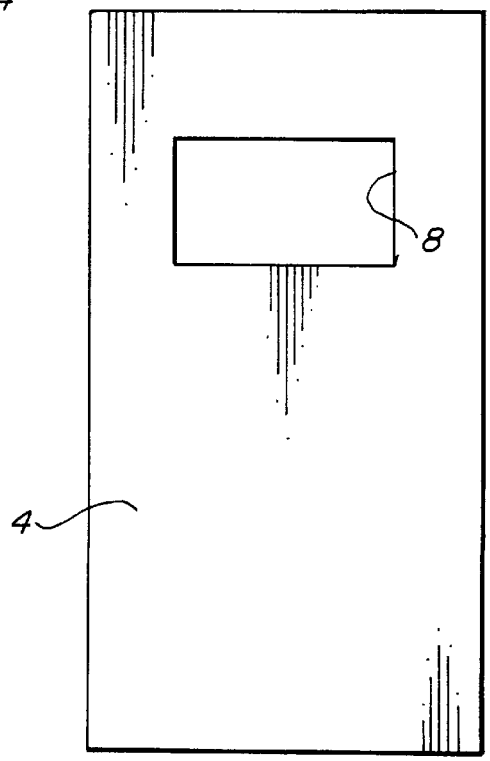
FIG. 5 is a plan view of a door panel showing the cutout for a lite.

As also seen in FIG. 2, a foam retainer generally designated by the numeral 12 is disposed between the panels 4 about the periphery of the cutout 8. It is of T-shaped configuration with a head portion 14 which abuts the lips 10, and the base portion 16 extends inwardly of the cutout 8.

Seated in the void provided by the cutouts 8 and between the projecting base portions 16 of the foam retainer 12 is a transparent lite generally designated by the numeral 18 and it has a configuration closely approximating the cutout 8 and peripheral dimensions which space it a short distance inwardly of the base portions 16. It is comprised of a pair of glass panels 20 and a spacer 22, and the air is evacuated from the enclosed space as is conventional.

An outer frame generally designated by the numeral 24 extends about the periphery of the cutout 8 on the outer panel 4 of the door. It has an intermediate body portion 26 which extends between the foam retainer 12 and the lite 18, and an outer side portion 28 which overlies a marginal portion of the panel 4 about the cutout 8. It also has an inner portion 30 which overlies a marginal portion of the lite 18. Waterproof seals 31, 33 are provided between the outer frame 24 and the transparent lite 18 and panel 4 respectively.

Clamping plates generally designated by the numeral 32 have a generally S-shaped configuration and have a first leg 34 which overlies the base portion 16 of the foam retainer 12 and are secured thereto by threaded fasteners 36 which extend into the body portion 26 of the outer frame 24. The other leg 38 of the clamping plate 32 overlies the transparent lite 18 which is thereby clamped against the outer frame 24 by tightening the threaded fasteners 36.

An inner frame generally designated by the numeral 40 is of configuration similar to that of the outer frame 24. It has a body portion 42 disposed between the lite 18 and foam retainer 12, an outer portion 44 overlying the inner panel 4 and an inner portion 46 overlying the lite 18. Between the inner frame 40 and the panel 4 and lite 18 are resiliently compressible elements 48. The body portion 42 is dimensioned to seat snugly in the space between the lite 18 and retainer 12 so that it is held without fasteners. It conceals the fasteners 36 and thus gives the door a "finished" appearance.

Surface portions 50 of the foam retainer member 12 may be provided with grooved surfaces which cooperates with grooved surfaces on the frames 24, 40 to increase frictional engagement therebetween.

The foam retainer is conveniently extruded from synthetic resin and, depending upon the configuration of the cutout, can be continuous or assembled from several sections. The frames may be fabricated from synthetic resin or metal extrusions, or milled from wood. Multiple clamping plates and threaded fasteners will be utilized to secure the parts in assembly.

In assembling the door, the panels 4 are fixed to the frame 2 in spaced relationship and with the cutouts 8 in alignment. The foam retainer 12 is placed between the panels 4 during this assembly step if lips 10 are provided on the panels 4. The space between the panels 4 is filled with synthetic resin foam in a conventional manner. If the foam retainer 12 is not formed as a unitary member, all of its joints must be sealed before the synthetic resin foam is inserted. The lips 10 on the panels 4 serve to locate foam retainers 12 during the assembly process and to secure it in position during the introduction of the foam. If desired, the lips 10 may be omitted, in which case the foam retainer 12 is secured in position by adhesive, by sonic welding, or by any other appropriate bonding method.

It will be appreciated that the use of the foam retainer permits the cutouts 8 to be formed in the panels 4 before attachment to the frame 2, thus facilitating the fabrication and ensuring accuracy. The synthetic resin foam is inserted only after the cutout 8 has been formed and sealed. Thus, waste of synthetic resin is avoided and metal scrap is not contaminated with resign material.

To install the lite, it and the outer frame 24 are placed in the cutout 8. The outer frame 24 will snap into place with its surface portions engaging surface portions 50 of the foam retainer 12. This allows a single worker to install the lite, working with the door in either a horizontal or a vertical position. From the internal side of the door, threaded fasteners 36 are passed through the clamping plates 32 through the foam retainer 12 and into the outer frame 24. Fabrication is completed by pressing the inner frame 40 against the inside of the door and snapping it into position with its surface portions 50 engaging surface portions 50 of the foam retainer 12.

It will be readily appreciated by those skilled in the art that various modifications may be made to the disclosed embodiment without departing from the spirit and contemplation of the invention which is intended to be limited in scope only by the appended claims.

Having thus described the invention, what is claimed is:

1. A composite door with a lite comprising:

(a) a pair of spaced panels providing the faces of the door and having aligned cutouts therein;

(b) a foam retaining member extending about the periphery of said cutouts with a first portion extending between said panels to effect a seal therewith and a mounting portion extending inwardly of said periphery of said cutouts;

(c) a translucent lite configured cooperatively with said cutouts and disposed therein;

(d) an external frame element extending about said periphery of said cutout in one of said panels and having a first portion overlying the outer surface of said one panel about said cutout and a second portion overlying said mounting portion and a marginal portion of the adjacent surface of said lite;

(e) engaging means securing said mounting portion of said foam retaining member and said external frame element in assembly and clamping said lite to said external frame element;

(f) an internal frame element extending about said periphery of said cutout in the other of said panels and having a first portion overlying the outer surface of said other panel about said cutout and a second portion overlying said mounting portion of said retaining member, a marginal portion of the other surface of said lite and said engaging means; and (g) cellular synthetic resin in a cavity defined by said panels and said foam retaining member, said cellular synthetic resin abutting said form retaining member.

2. The composite door of claim 1 wherein said foam retaining member is of generally T-shaped configuration with a head portion extending between said panels to effect said seal and a base portion providing said mounting portion.

3. The composite door of claim 1 wherein said panels have inwardly extending lips about said cutouts and said foam retaining member abuts the interior surface of said lips.

4. The composite door of claim 1 wherein said engaging means includes (a) a clamping plate bearing upon the surface of said lite opposite from that adjacent said external frame element and (b) threaded fasteners extending through said clamping plate and said mounting portion of said foam retaining member and engaging said external frame element, whereby tightening of said threaded fasteners draws said external frame element towards said plate.

5. The composite door of claim 4 wherein said clamping plate has a generally L-shaped portion overlying said marginal portion of said lite and a portion of its peripheral edge and a flange which extends over said mounting portion of said foam retaining member, said fasteners extending through said flange and mounting portion.

6. The composite door of claim 5 wherein said interior frame element second portion has a projection which is frictionally engaged between said foam retaining member and said L-shaped portion of said clamping plate.

7. The composite door of claim 6 wherein said projection is dimensioned and configured to snap fit into spacing between said frame retaining member and L-shaped portion of said clamping plate.

8. The composite door of claim 1 wherein said foam retaining member is fabricated of synthetic resin.

9. The composite door of claim 1 including sealing means between said lite and said outer frame element.

10. A method for forming a composite door having a lite comprising the steps of:

(a) assembling a pair of substantially planar rectangular door panels in spaced relationship with cutouts formed therein in substantial alignment;

(b) placing a foam retaining member in said cutouts with a first portion extending between said panels in sealing relationship with said panels about said cutouts and a second portion extending inwardly of the periphery of said cutouts;

(c) introducing synthetic resin foam into the cavity defined by said panels and said foam retaining member;

(d) inserting a translucent lite into said cutouts; and (e) securing said lite to said foam retaining member by:

(i) providing an external lite frame element on the external surface of one of said panels and said lite;

(ii) placing a lite clamping element against the other surface of said lite; and (iii) securing said external lite frame element and said lite clamping element to said second portion of said foam retaining member to clamp said lite between said lite clamping element and said frame element.

11. The method of forming a door with a lite in accordance with claim 10 wherein said external lite frame element securing step is effected by fasteners extending between said lite clamping element and external lite frame element through said second portion of said foam retaining member.

12. The method of forming a door with a lite in accordance with claim 10 wherein said lite securing step includes placing an internal lite frame element against said lite in a position overlying said lite clamping element and securing it in assembly with said lite and foam retaining member.

13. The method of forming a door with a lite in accordance with claim 10 including the step of forming said panels with inwardly extending lips about said cutouts and wherein said placing step places said first portion of said foam retaining member against the interior surface of said lips to effect said sealing relationship.

14. The method of forming a door with a lite in accordance with claim 12 wherein said lite is of lesser dimension than said cutout to provide a spacing thereabout and there is included the step of forming said internal lite frame element with a portion dimensioned to seat into a spacing between said foam retaining member and a portion of said lite clamping element and frictionally engaging said dimensioned portion in said space.

15. The method of forming a door with a lite in accordance with claim 10 including the step of placing sealing material between adjacent surfaces of said lite and said external lite frame element.

* * * * *